US009470071B2

(12) United States Patent
Morrison et al.

(10) Patent No.: US 9,470,071 B2
(45) Date of Patent: Oct. 18, 2016

(54) REDUNDANT FIRING SYSTEM FOR WELLBORE TOOLS

(71) Applicant: Owen Oil Tools LP, Houston, TX (US)

(72) Inventors: Ian Morrison, Grandbury, TX (US); Lyle W. Andrich, Grandview, TX (US); Timothy E. Lagrange, Rainbow, TX (US); Bradley J. Vass, Fort Worth, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 0 days.

(21) Appl. No.: 14/676,548

(22) Filed: Apr. 1, 2015

(65) Prior Publication Data

US 2015/0285040 A1 Oct. 8, 2015

Related U.S. Application Data

(60) Provisional application No. 61/974,720, filed on Apr. 3, 2014.

(51) Int. Cl.
*E21B 43/116* (2006.01)
*E21B 43/1185* (2006.01)
*F24D 1/04* (2006.01)

(52) U.S. Cl.
CPC ..... *E21B 43/1185* (2013.01); *E21B 43/116* (2013.01); *F24D 1/04* (2013.01)

(58) Field of Classification Search
CPC .... E21B 43/11; E21B 43/116; E21B 43/117; E21B 43/1185; E21B 43/248; E21B 43/263; F42D 1/04; F42D 1/043
USPC ..... 102/306–313, 322; 89/1.15; 175/4.54, 175/4.55, 4.56, 4.6
See application file for complete search history.

(56) References Cited

U.S. PATENT DOCUMENTS

| | | | | |
|---|---|---|---|---|
| 2,257,271 | A | 2/1940 | McCullough | |
| 2,955,533 | A | 12/1954 | Martinez, Jr. | |
| 3,101,051 | A * | 8/1963 | Gilbert | E21B 43/117 166/55.2 |
| 5,007,344 | A * | 4/1991 | Ricles | E21B 23/02 102/312 |
| 5,012,741 | A * | 5/1991 | Peebles | C06C 5/06 102/275.3 |
| 5,386,780 | A | 2/1995 | Klein | |
| 5,551,520 | A | 9/1996 | Bethel et al. | |
| 8,973,502 | B2 * | 3/2015 | Scheid | F42D 1/043 102/217 |
| 2009/0071362 | A1 * | 3/2009 | Scheid | F42B 3/00 102/322 |

OTHER PUBLICATIONS

PCT/US2015/024113—International Search Report dated Apr. 2, 2015.

* cited by examiner

*Primary Examiner* — James S Bergin
(74) *Attorney, Agent, or Firm* — Mossman, Kumar & Tyler, PC

(57) ABSTRACT

An apparatus for detonating an explosive body associated with a downhole tool includes a plurality of firing heads, each firing head including an initiating explosive body generating a high-order input when detonated; and a funnel configured to detonate the explosive body associated with the downhole tool by using a single high-order output. The funnel has a body that includes: a plurality of input openings, each input opening positioned next to an associated initiating explosive body to receive the generated high-order input, a single output opening, and a flow path connecting the plurality of input openings with the single output opening.

13 Claims, 4 Drawing Sheets

REDUNDANT FIRING SYSTEM FOR WELLBORE TOOLS

CROSS REFERENCE TO RELATED APPLICATIONS

This application claims priority from U.S. Provisional Application Ser. No. 61/974,720 filed Apr. 3, 2014 the entire disclosure of which is incorporated herein by reference in its entirety.

TECHNICAL FIELD

The present disclosure relates to devices and methods for firing one or more downhole tools. More particularly, the present disclosure is in the field of control devices and methods for enhancing the reliability of firing systems used to fire a ballistic downhole tool.

BACKGROUND

One of the activities associated with the completion of an oil or gas well is the perforation of a well casing. During this procedure, perforations, such as passages or holes, are formed in the casing of the well to enable fluid communication between the well bore and the hydrocarbon producing formation that is intersected by the well. These perforations are usually made with a perforating gun loaded with shaped charges. The gun is lowered into the wellbore on electric wireline, slickline or coiled tubing, or other means until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow from the formation through the perforations and into the production string for flowing to the surface.

Many oil well tools incorporate a high-order detonation as part of their operation. When the systems used to initiate the high-order detonation malfunction, it can be costly and time consuming to repair and re-attempt to perform a desired wellbore operation. The present disclosure relates to methods and devices for enhancing the reliability of devices used to generate high-order detonations.

SUMMARY

In aspects, the present disclosure provides an apparatus for detonating an explosive body associated with a downhole tool. The apparatus may include a plurality of firing heads and a funnel. Each firing head may include an initiating explosive body generating a high-order input when detonated. The funnel detonates the explosive body associated with the downhole tool by using a single high-order output. The funnel has a body that includes a plurality of input openings, a single output opening, and a flow path connecting the plurality of input openings with the single output opening. Each input opening may be positioned next to an associated initiating explosive body to receive the generated high-order input.

In another embodiment, the apparatus may include a plurality of side-by-side firing heads, each firing head including an initiating explosive body generating a high-order input when detonated and a funnel. The funnel may include a plurality of input openings, each input opening being positioned next to an associated initiating explosive body to receive the generated high-order input, wherein each input opening is in communication with an associated passage, a juncture connecting the associated passages of the plurality of input openings, a single output passage having a first end connected to the juncture and a second end, and a single output opening formed at the second end of the single output passage.

It should be understood that certain features of the disclosure have been summarized rather broadly in order that the detailed description thereof that follows may be better understood, and in order that the contributions to the art may be appreciated. There are, of course, additional features of the disclosure that will be described hereinafter and which will in some cases form the subject of the claims appended thereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION

Figure 1:
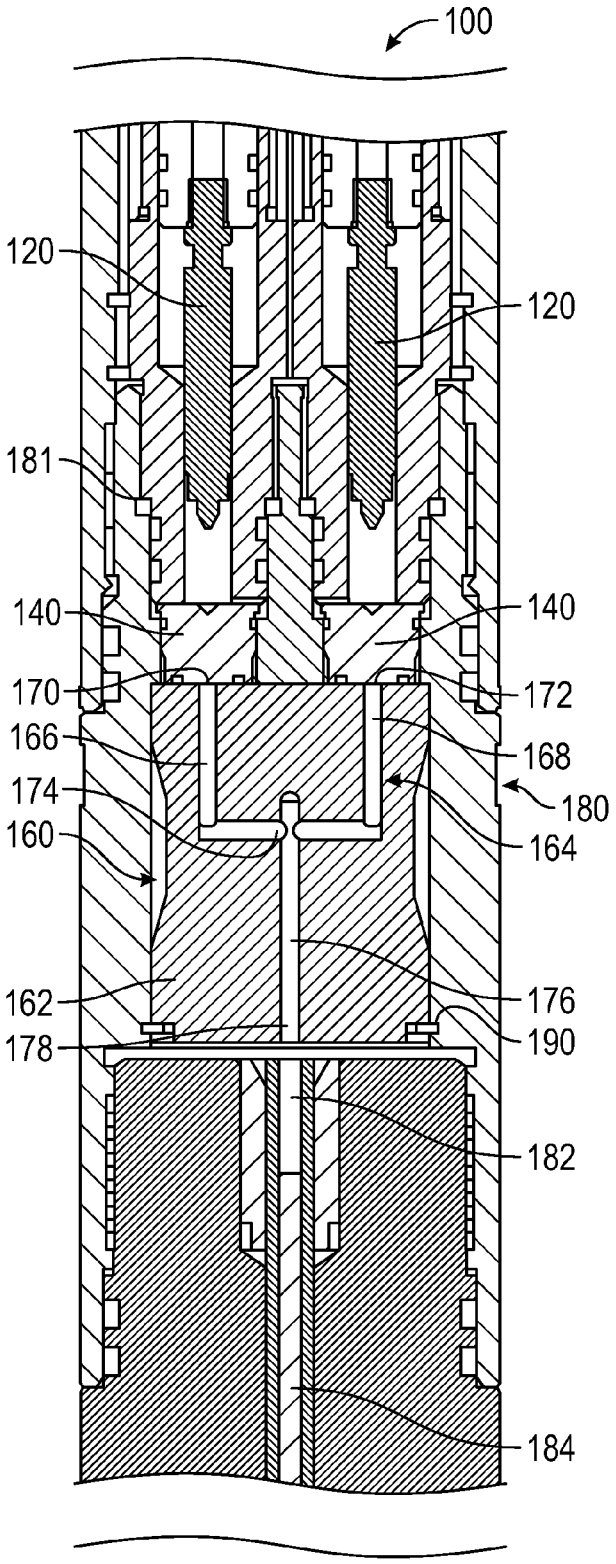
FIG. 1 illustrates a side sectional view of a detonator firing system according to one embodiment of the present disclosure.

The present disclosure relates to devices and methods for providing a redundant firing system for activating one or more downhole tools. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring initially to FIG. 1, there is sectionally illustrated schematically illustrated one non-limiting embodiment of a firing assembly 100 made in accordance with the present disclosure. The firing assembly 100 may include a plurality of firing heads 120, a plurality of initiating explosive bodies 140, and a funnel 160. These components may be secured within an enclosure 180. The enclosure 180 may be formed of one or more tubular members. The firing heads 120 may be activated by using a percussive tool, a pressure-activated mechanism, an electrical signal, or any other known activating arrangement. The firing heads 220 may be positioned side-by-side to facilitate simultaneous activation. The firing heads 200 may be activated independently or may share the same activation mechanism. Each firing head 120 is individually sealed within a cavity of the enclosure using suitable seals. Thus, the high-order of the initiating explosive bodies 140 are isolated from one another before ending the funnel 160. The funnel 160 may be energetically connected to an adjacent downhole tool by using a secondary explosive body 182 and a detonating cord 184.

The funnel 160 includes a body 162 and a flow path 164. The flow path 164 has a plurality of inlet passages 166, 168 in communication with openings 170, 172, respectively, formed in the body 162, which may be a cylindrical member. The openings 170, 172 are next to the initiating explosive bodies 140. The inlet passages 166, 168 terminate at a juncture 174 with a single outlet passage 176. The single outlet passage 176 is in communication with an opening 178 formed in the body 162, which is next to the secondary explosive body 182. Thus, the high-order output of the initiating explosive bodies 140 enter the body 162 separately via the openings 170, 172, but consolidate at the juncture 174 and exit as a single high-order output from the opening 178. The single high-order output may be used to detonate the secondary explosive body 182.

The enclosure 180 may include threaded connections 181 to connect with adjacent structures, such as subs or housings. The enclosure 180 may provide a liquid-tight sealed interior for the firing heads 120, initiating explosive bodies 140, and the funnel 160. Also, the funnel 160 may be retained within the enclosure 180 using a retaining ring 190.

Figure 2:
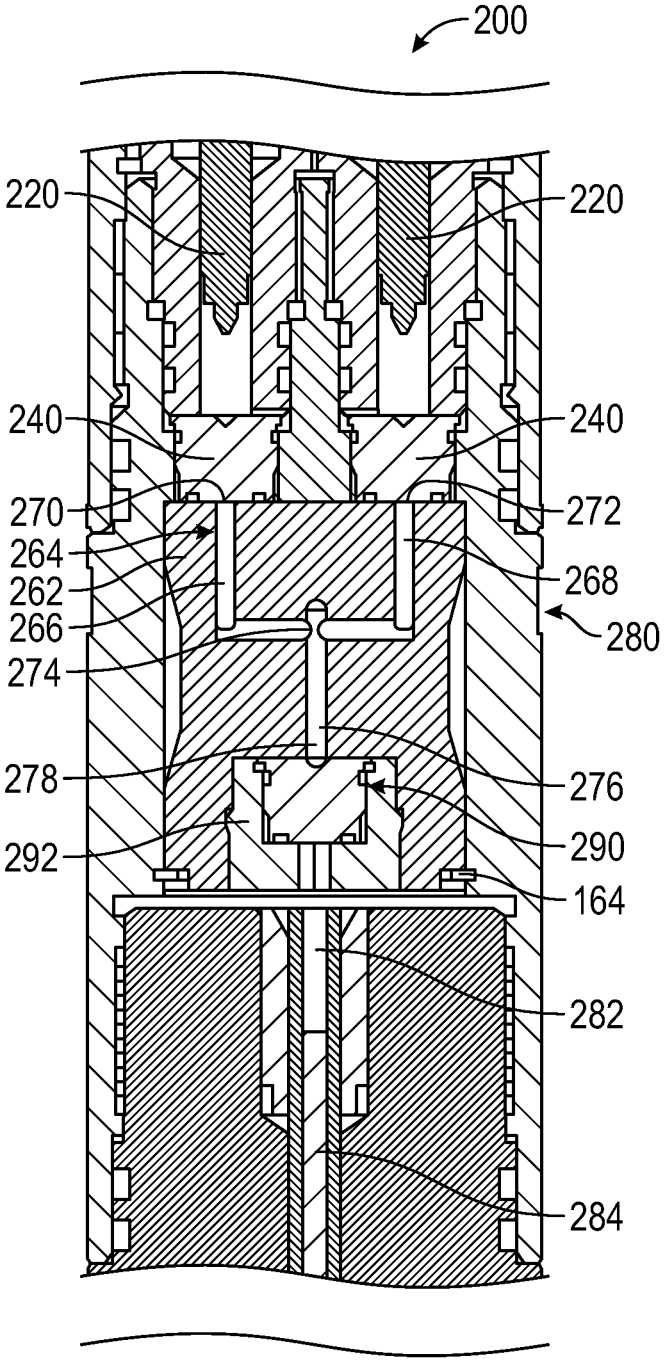
FIG. 2 illustrates a side sectional view of a detonator firing system according to one embodiment of the present disclosure.

Referring now to FIG. 2, there is sectionally illustrated schematically illustrated another non-limiting embodiment of a firing assembly 200 made in accordance with the present disclosure. The firing assembly 200 may include a plurality of firing heads 220, a plurality of high-order explosive materials 240, and a funnel 260. These components may be secured within an enclosure 280. The firing heads 220 may be activated using a firing signal provided by using a percussive tool, a pressure-activated mechanism, an electrical signal, or any other known activating arrangement. The firing heads 220 may be positioned side-by-side to facilitate simultaneous activation by using the same firing signal. By simultaneous, it is meant within ten seconds of one another, with a second of one another, within a fraction of a second of one another. The firing heads 200 may be activated independently or may share the same activation mechanism. The funnel 260 may be energetically connected to an adjacent downhole tool by using a secondary explosive body 282 and a detonating cord 284.

The funnel 260 includes a body 262, a flow path 264, and an initiator 290. The flow path 264 has a plurality of inlet passages 266, 268 in communication with openings 270, 272, respectively, formed in the body 262. The openings 270, 272 are next to a high-order explosive material 240. The inlet passages 266, 268 terminate at a juncture 274 with a single outlet passage 276. The single outlet passage 276 is in communication with opening 278 in the body 262, which is next to the initiator 290. The initiator 290 may be secured within a recess bore 292 or other similar cavity formed in the body 262. The initiator 290 may include a high-order explosive that generates a high-order output when detonated. This high-order output is directed to the secondary explosive body 282.

Thus, the high-order outputs of the initiating explosive bodies 240 enter the body 262 separately via the openings 270, 272, and consolidate at the juncture 274 and exit as a single high-order output from the opening 278. The single high-order output may be used to detonate the initiator 290. The initiator 290, in response, generates a high-order output that detonates the secondary explosive body 282, which then detonates the detonator cord 284.

Referring now to FIGS. 3A-D, there are shown different embodiments of a funnel 160 for consolidating two or more high-order inputs into a single high-order output.

Figure 3A:
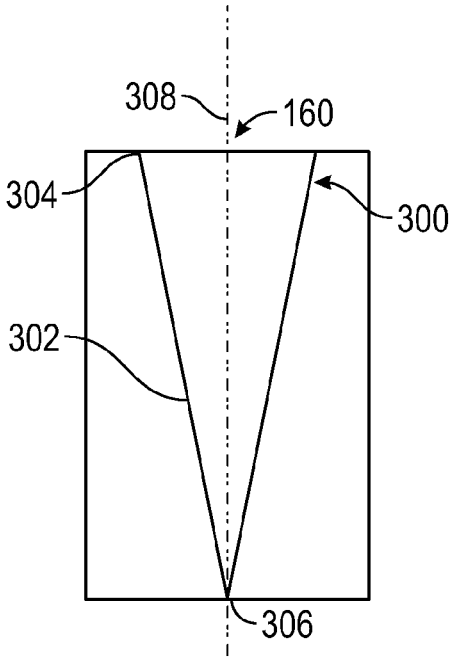
FIG. 3A-D schematically illustrates a side views of flow paths according to various embodiments of the present disclosure.

FIG. 3A shows one alternate embodiment of a funnel 160 according to the present disclosure. The funnel 160 includes a flow path 300 having a plurality of passages 302. Each passage 302 has a separate opening 304 for receiving a high-order input. However, the passages 302 communicate with a common opening 306 through which the high-order input exits. The passages 302 may be generally straight (linear) and non-parallel to one another or with an axis 308 that is generally aligned with the direction of travel of the shock-wave. As show, the passages 302 are non-parallel for their entire length but may also be non-parallel for a majority of the respective lengths (i.e., more than 50%).

Figure 3B:
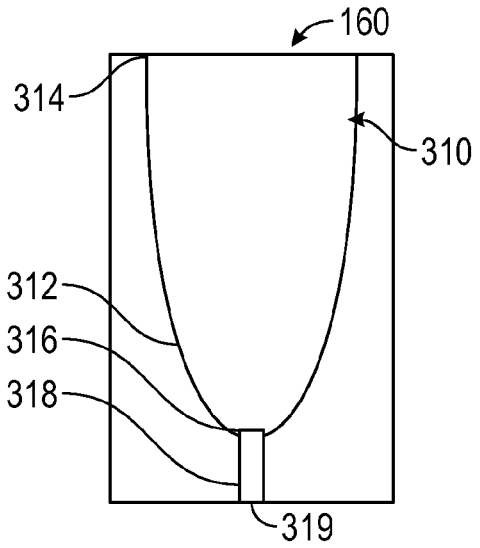

FIG. 3B shows another alternate embodiment of a funnel 160 according to the present disclosure. The funnel 160 includes a flow path 310 having a plurality of passages 312. Each passage 312 is in communication with a separate opening 314 for receiving a high-order input. The passages 312 intersect at a juncture 316 which connects to an outlet passage 318. The outlet passage is in communication with an opening 319 through which the high-order input exits. The passages 312 are curved (non-linear). Additionally, the outlet passage 318 has a diameter that is substantially larger (i.e., at least twenty percent larger) in size than the diameter of the passages 312.

Figure 3C:
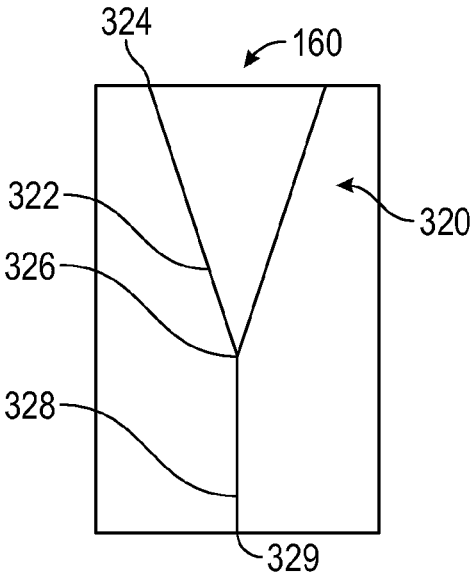

FIG. 3C shows another alternate embodiment of a funnel 160 according to the present disclosure. The funnel 160 includes a flow path 320 having a plurality of passages 322. Each passage 322 is in communication with a separate opening 324 for receiving a high-order input. The passages 322 intersect at a juncture 326 which connects to an outlet passage 328. The outlet passage is in communication with an opening 329 through which the high-order input exits. The passages 322 are linear and form a "V" shape.

Figure 3D:
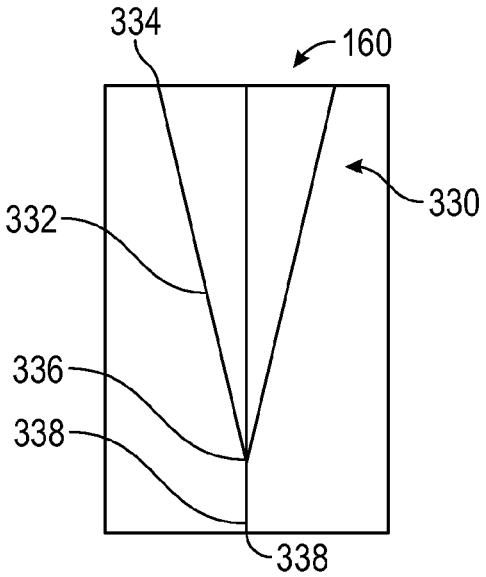

FIG. 3D shows another alternate embodiment of a funnel 160 according to the present disclosure. The funnel 160 includes a flow path 330 having three passages 332. Each passage 332 is in communication with a separate opening 334 for receiving a high-order input. The passages 322 intersect at a juncture 336 which connects to an outlet passage 338. The outlet passage is in communication with an opening 339 through which the high-order input exits. It should be understood that embodiments may also use four or more passages 332.

One illustrative mode of use of the firing system 100 will be discussed in connection with FIGS. 1 and 4. For clarity, the firing system 100 will be discussed with reference to perforating guns. It should be appreciated, however, that the firing system 100 is not limited to such use.

Figure 4:
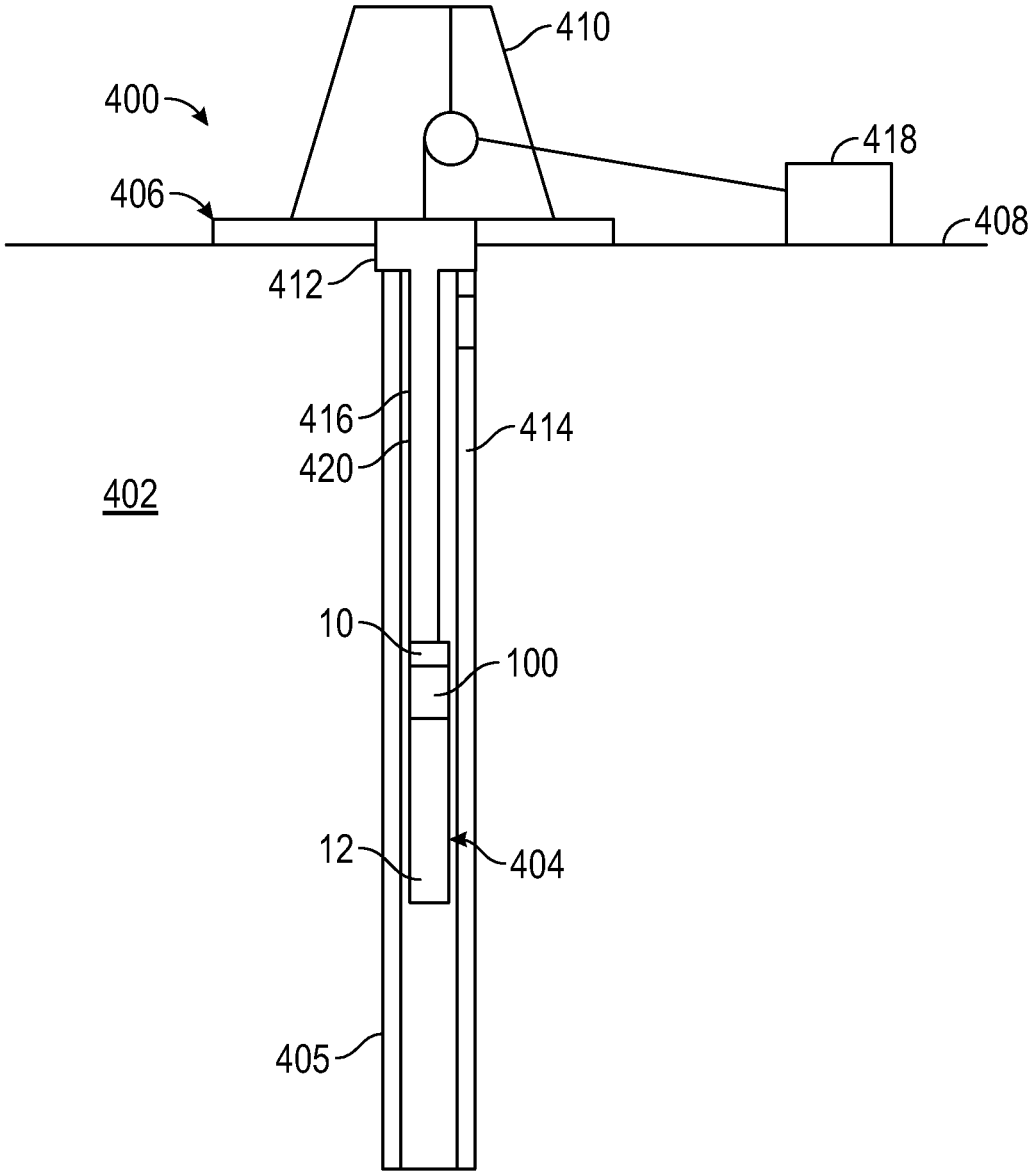
FIG. 4 schematically illustrates an elevation view of a surface facility adapted to perform one or more pre-defined tasks in a wellbore using one or more downhole tools.

Referring to FIG. 4, there is shown a well construction and/or hydrocarbon production facility 400 positioned over a subterranean formation of interest 402. A firing system 100 made in accordance with the present disclosure in connection with a downhole tool 404 adapted to perform one or more predetermined downhole tasks in a well bore 405. The facility 400 can include known equipment and structures such as a platform 406 at the earth's surface 408, a rig 410, a wellhead 412, and cased or uncased pipe/tubing 414. A work string 416 is suspended within the well bore 405 from the rig 410. The work string 416 can include drill pipe, coiled tubing, wire line, slick line, or any other known conveyance means. The work string 416 can include telemetry lines or other signal/power transmission mediums that establish one-way or two-way telemetric communication from the surface to the downhole tool 404 connected to an end of the work string 416. For brevity, a telemetry system having a surface controller (e.g., a power source) 418 adapted to transmit electrical signals via a cable or signal transmission line 420 disposed in the work string 416 is shown.

In one mode of use, the firing system 100 is incorporated into the tool 404. The tool 404 may include and a well tool 12 that is fired or otherwise activated using a high-order detonation. As discussed previously, the signal for firing the firing system 100 may be a pressure change, an impact, a time delay, an electrical signal, or any other suitable actuating methodology. Normally, all of the firing heads 120 are activated by the signal and will impact their associated initiating explosive bodies 140. Upon impact, the initiating explosive bodies 140 each undergo a high-order detonation. These detonations cause shock waves to separately enter the opening 170, 172. The shock waves travel along their respective passages 166, 168, combine at the juncture 174, and then travel as a consolidated shock wave along the single outlet passage 176. The consolidated shock wave exits from the single outlet passage 176 and detonates the high-order explosive material 182.

If one of the firing heads 120 fails to activate, then remaining functional firing head 120 impacts and detonates the associated initiating explosive bodies 140. This detonation causes a shock wave to enter either opening 170 or 172. The shock wave travels along either passage 166 or 168, and enters the single outlet passage 176 via the juncture 174. The shock wave exits from the single outlet passage 176 and detonates the high-order explosive material 182. Thus, a successful firing event is obtained even though less than all of the firings heads 120 were functional.

As used above, a high-order detonation is a detonation that produces high amplitude pressure waves (e.g., shock waves) and thermal energy. Likewise, a high-order explosive is an explosive formulated to generate a high-order detonation when detonated. In firing head assemblies, a high-order detonation occurs when a firing pin percussively impacts and detonates a detonator that includes a high-order explosive. The primary and secondary explosive bodies, as well as the activator, may use one or more high-explosives. Illustrative high-explosives include, but are not limited, to RDX (Hexogen, Cyclotrimethylenetrinitramine), HMX (Octagon, Cyclotetramethylenetetranitramine), HNS, and PYX.

From the above, it should be appreciated that what has been disclosed includes an apparatus for detonating an explosive body associated with a downhole tool. The apparatus may include a plurality of firing heads and a funnel. Each firing head may include an initiating explosive body generating a high-order input when detonated. The funnel detonates the explosive body associated with the downhole tool by using a single high-order output. The funnel has a body that includes a plurality of input openings, a single output opening, and a flow path connecting the plurality of input openings with the single output opening. Each input opening may be positioned next to an associated initiating explosive body to receive the generated high-order input. In embodiments, the flow path may include a plurality of inlet passages, each inlet passage in communication with one of the input openings, a single outlet passage in communication with the single output opening, and a juncture connecting the plurality of inlet passages with the single outlet passage. In embodiments, the apparatus may also include an activator positioned in the funnel and adjacent to the single output opening. The activator may detonate the explosive body associated with the downhole tool using a high-order detonation.

From the above, it should be appreciated that what has been disclosed also includes an apparatus that may include a plurality of side-by-side firing heads, each firing head including an initiating explosive body generating a high-order input when detonated and a funnel. The funnel may include a plurality of input openings, each input opening being positioned next to an associated initiating explosive body to receive the generated high-order input, wherein each input opening is in communication with an associated passage, a juncture connecting the associated passages of the plurality of input openings, a single output passage having a first end connected to the juncture and a second end, and a single output opening formed at the second end of the single output passage. In embodiments, the passages associated with the plurality of input openings may be non-parallel to one another for a majority of a length of each associated passage. In embodiments, the single outlet passage has a diameter that is at least twenty percent larger in size than the diameter of the passages associated with the plurality of input openings. Also, the apparatus may include an enclosure having a sealed interior in which the plurality of firing heads and funnel are disposed. The enclosure may be configured to isolate the high-order output of the initiating explosive bodies from one another before entering the funnel. The side-by-side firing heads may be configured to be simultaneously activated by the same firing signal. In arrangements, the downhole tool further may include a detonator cord detonated by the explosive body. In embodiments, the apparatus may include an initiator positioned adjacent to the single output opening, the initiator including a high-order explosive that generates a high-order output when detonated by the high-order detonation, the high-order output of the high-order explosive being configured to detonate the explosive body.

From the above, it should be appreciated that what has been disclosed further includes embodiments wherein the passages associated with the plurality of input openings may be non-parallel to one another for a majority of a length of each associated passage, wherein the plurality of side-by-side firing heads are configured to be simultaneously activated by the same firing signal, and the apparatus may further include an enclosure having a sealed interior in which the plurality of firing heads and funnel are disposed, the enclosure being configured to isolate the high-order output of the initiating explosive bodies from one another before the high-order outputs enter the funnel.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. An apparatus for detonating an explosive body associated with a downhole tool, comprising:

a plurality of firing heads, each firing head including an initiating explosive body generating a high-order input when detonated; and a funnel configured to detonate the explosive body associated with the downhole tool by using a single high-order output, the single high-order output being formed of at least one of the generated high-order inputs, the funnel having a body that includes:

a plurality of input openings, each input opening positioned next to the associated initiating explosive body to receive the generated high-order input, each associated initiating explosive body being completely external to the funnel, a single output opening being oriented to direct the single high-order output to the explosive body associated with the downhole tool; and a flow path connecting the plurality of input openings with the single output opening.

2. The apparatus of claim 1, wherein the flow path includes:

a plurality of inlet passages, each inlet passage in communication with one of the input openings, a single outlet passage in communication with the single output opening, and a juncture connecting the plurality of inlet passages with the single outlet passage, the juncture being configured to consolidate the high-order input of each initiating explosive body to form the single high-order output.

3. The apparatus of claim 1, further comprising:

an initiator positioned in the funnel and adjacent to the single output opening, the initiator detonating the explosive body associated with the downhole tool using a high-order detonation, the activator being detonated by the high-order output exiting the single output opening.

4. An apparatus for detonating an explosive body associated with a downhole tool, comprising:

a plurality of side-by-side firing heads, each firing head including an initiating explosive body generating a high-order input when detonated;

a funnel having a body that includes:

a plurality of input openings, each input opening being positioned next to an associated initiating explosive body that is completely external the funnel, each input opening being positioned to receive the generated high-order input, wherein each input opening is in communication with an associated passage, a juncture connecting the associated passages of the plurality of input openings, a single output passage having a first end connected to the juncture and a second end, and a single output opening formed at the second end of the single output passage, wherein the plurality of input openings, the juncture, and the single output passage cooperate to form a single high-order output from of at least one of the generated high-order inputs, the second end oriented to direct the single high-order output to the explosive body.

5. The apparatus of claim 4, wherein the passages associated with the plurality of input openings are non-parallel to one another for a majority of a length of each associated passage.

6. The apparatus of claim 5, wherein the single outlet passage has a diameter that is at least twenty percent larger in size than the diameter of the passages associated with the plurality of input openings.

7. The apparatus of claim 4, further comprising an enclosure having a sealed interior in which the plurality of firing heads and the funnel are disposed.

8. The apparatus of claim 7, wherein the enclosure is configured to isolate the high-order output of the initiating explosive bodies from one another before entering the funnel.

9. The apparatus of claim 4, where the plurality of side-by-side firing heads are configured to be simultaneously activated by the same firing signal.

10. The apparatus of claim 4, where the downhole tool further comprises a detonator cord detonated by the explosive body.

11. The apparatus of claim 4, further comprising an initiator positioned adjacent to the single output opening, the initiator including a high-order explosive that generates a high-order output when detonated by the single high-order output, the high-order output of the high-order explosive being configured to detonate the explosive body.

12. The apparatus of claim 4, wherein the passages associated with the plurality of input openings are non-parallel to one another for a majority of a length of each associated passage, wherein the plurality of side-by-side firing heads are configured to be simultaneously activated by a same firing signal, and further comprising an enclosure having a sealed interior in which the plurality of firing heads and funnel are disposed, the enclosure being configured to isolate the high-order input of the initiating explosive bodies from one another before the high-order outputs enter the funnel.

13. An apparatus for detonating a downhole tool, comprising:

an explosive body configured to detonate the downhole tool;

a plurality of firing heads, each firing head including an initiating explosive body generating a high-order input when detonated; and a funnel separating the explosive body and the plurality of firing heads, the funnel being configured to detonate the explosive body associated with the downhole tool by using a single high-order output, the single high-order output being formed of at least one of the generated high-order inputs, the funnel having a body that includes:

a plurality of input openings, each input opening positioned next to the associated initiating explosive body to receive the generated high-order input a single output opening from which the single high-order output exits, and a flow path connecting the plurality of input openings with the single output opening.

* * * * *